US006689723B2

(12) United States Patent
Sullivan et al.

(10) Patent No.: US 6,689,723 B2
(45) Date of Patent: Feb. 10, 2004

(54) SULFIDE- AND POLYSULFIDE-CONTAINING LUBRICATING OIL ADDITIVE COMPOSITIONS AND LUBRICATING COMPOSITIONS CONTAINING THE SAME

(75) Inventors: William T. Sullivan, Brick, NJ (US); Percy Rohinton Kanga, Cherry Hill, NJ (US); Thomas Smith Coolbaugh, Yardley, PA (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/091,249

(22) Filed: Mar. 5, 2002

(65) Prior Publication Data

US 2003/0171222 A1 Sep. 11, 2003

(51) Int. Cl.[7] ..... C10M 135/22

(52) U.S. Cl. ..... 508/185; 508/192; 508/199; 508/371; 508/421; 508/569

(58) Field of Search ..... 508/569, 185

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,197,263 | A | 4/1940 | Carmichael et al. |
| 2,387,501 | A | 10/1945 | Dietrich |
| 2,564,561 | A | 8/1951 | Carmichael et al. |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,945,749 | A | 7/1960 | Andress, Jr. |
| 2,999,066 | A | 9/1961 | Liddy |
| 3,197,405 | A | 7/1965 | Le Suer |
| 3,213,020 | A | 10/1965 | Hopkins et al. |
| 3,213,021 | A | 10/1965 | Hopkins et al. |
| 3,213,022 | A | 10/1965 | Hopkins et al. |
| 3,219,666 | A | 11/1965 | Norman et al. |
| 3,250,715 | A | 5/1966 | Wyman |
| 3,254,025 | A | 5/1966 | Le Suer |
| 3,275,554 | A | 9/1966 | Wagenaar |
| 3,282,955 | A | 11/1966 | Le Suer |
| 3,313,727 | A | 4/1967 | Peeler |
| 3,382,291 | A | 5/1968 | Brennan |
| 3,438,757 | A | 4/1969 | Honnen et al. |
| 3,454,555 | A | 7/1969 | Van der Voort et al. |
| 3,491,025 | A | 1/1970 | Lee |
| 3,533,945 | A | 10/1970 | Vogel |
| 3,544,465 | A | 12/1970 | Braid |
| 3,565,804 | A | 2/1971 | Honnen et al. |
| 3,666,662 | A | 5/1972 | Lowe |
| 3,742,082 | A | 6/1973 | Brennan |
| 3,755,433 | A | 8/1973 | Miller et al. |
| 3,769,363 | A | 10/1973 | Brennan |
| 3,819,521 | A | 6/1974 | Sims |
| 3,822,289 | A | 7/1974 | Clark et al. |
| 3,853,772 | A | 12/1974 | Adams |
| 3,876,720 | A | 4/1975 | Heilman et al. |
| 3,980,569 | A | 9/1976 | Pindar et al. |
| 3,997,454 | A | 12/1976 | Adams |
| 4,089,790 | A | 5/1978 | Adams |
| 4,119,549 | A | 10/1978 | Davis |
| 4,191,659 | A | 3/1980 | Davis |
| 4,218,330 | A | 8/1980 | Shubkin |
| 4,234,435 | A | 11/1980 | Meinhardt et al. |
| 4,239,930 | A | 12/1980 | Allphin et al. |
| 4,344,854 | A | 8/1982 | Davis et al. |
| 4,367,352 | A | 1/1983 | Watts, Jr. et al. |
| 4,413,156 | A | 11/1983 | Watts, Jr. et al. |
| 4,454,059 | A | 6/1984 | Pindar et al. |
| 4,582,618 | A | 4/1986 | Davis |
| 4,584,115 | A | 4/1986 | Davis |
| 4,604,491 | A | 8/1986 | Dressler et al. |
| 4,658,072 | A | 4/1987 | Johnson |
| 4,670,169 | A | 6/1987 | Adams et al. |
| 4,714,794 | A | 12/1987 | Yoshida et al. |
| 4,755,311 | A | 7/1988 | Burjes et al. |
| 4,770,807 | A | 9/1988 | Musikas et al. |
| 4,827,064 | A | 5/1989 | Wu |
| 4,827,073 | A | 5/1989 | Wu |
| 4,876,374 | A | 10/1989 | Adams et al. |
| 4,904,401 | A | 2/1990 | Ripple et al. |
| 4,910,355 | A | 3/1990 | Shubkin et al. |
| 4,914,254 | A | 4/1990 | Pelrine |
| 4,925,983 | A | 5/1990 | Steckel |
| 4,926,004 | A | 5/1990 | Pelrine et al. |
| 4,938,881 | A | 7/1990 | Ripple et al. |
| 4,952,328 | A | 8/1990 | Davis et al. |
| 4,956,122 | A | 9/1990 | Watts et al. |
| 4,957,649 | A | 9/1990 | Ripple et al. |
| 4,967,032 | A | 10/1990 | Ho et al. |
| 5,012,020 | A | 4/1991 | Jackson et al. |
| 5,055,626 | A | 10/1991 | Ho et al. |
| 5,068,487 | A | 11/1991 | Theriot |

(List continued on next page.)

FOREIGN PATENT DOCUMENTS

| | | |
|---|---|---|
| EP | 168 534 | 1/1986 |
| EP | 496 486 | 7/1992 |
| EP | 695 798 | 2/1996 |
| WO | WO 86/05501 | 9/1986 |
| WO | WO 87/07638 | 12/1987 |
| WO | WO 96/29381 | 9/1996 |

*Primary Examiner*—Ellen M. McAvoy
(74) *Attorney, Agent, or Firm*—Louis N. Moreno

(57) ABSTRACT

This invention relates to a lubricating composition comprising a major amount of an oil of lubricating viscosity, at least one organic polysulfide comprising less than about 88% dihydrocarbyl trisulfide, from up to about 5% dihydrocarbyl disulfide, and more than about 7 wt. % dihydrocarbyl higher polysulfides, and at least one phosphorus or boron compound, or mixtures of two or more thereof. The invention also relates to concentrates and greases containing the above combination. The invention also relates to methods of making the organic polysulfide.

14 Claims, No Drawings

U.S. PATENT DOCUMENTS 5,146,021 A 9/1992 Jackson et al.
5,171,195 A 12/1992 Funamoto
5,230,714 A 7/1993 Steckel
5,242,613 A * 9/1993 Ozbalik et al. ..... 508/569
5,250,737 A * 10/1993 Ozbalik ..... 568/21
5,344,577 A * 9/1994 Deckman et al. ..... 508/569
5,344,578 A 9/1994 Wei et al.
5,371,248 A 12/1994 Rudnick
5,395,538 A 3/1995 Rudnick et al.
5,403,501 A * 4/1995 Schwind ..... 508/186
5,415,794 A * 5/1995 Aberkane et al. ..... 508/569
5,442,123 A * 8/1995 Arretz et al. ..... 568/26
5,552,071 A 9/1996 Rudnick et al.
5,602,086 A 2/1997 Le et al.
6,242,652 B1 * 6/2001 Bennett ..... 568/26
6,399,832 B1 * 6/2002 Bennett ..... 568/26
6,489,271 B1 * 12/2002 Richardson ..... 508/186

* cited by examiner

SULFIDE- AND POLYSULFIDE-CONTAINING LUBRICATING OIL ADDITIVE COMPOSITIONS AND LUBRICATING COMPOSITIONS CONTAINING THE SAME

TECHNICAL FIELD OF THE INVENTION

The present invention relates to the preparation and use of an additive for lubrication oils in which the additive includes at least one dihydrocarbyl polysulfide compound. The present invention also relates to finished lubrication oils having the dihydrocarbyl polysulfide additive and a base stock. In particular, the present invention relates to the use of a mixture of a dihydrocarbyl sulfide and dihydrocarbyl polysulfides having a desired ratio to provide a finished lubrication oil having certain desired performance attributes. This invention further relates to lubricating compositions, concentrates and greases containing the combination of a dihydrocarbyl polysulfide and a phosphorus or boron compound.

BACKGROUND OF THE INVENTION

Polysulfides have been used in lubrication compositions to provide extreme pressure protection. The polysulfides have certain disadvantages including copper corrosion, oxidation stability, thermal instability and seal compatibility problems. Additionally, the use of a polysulfide compound to improve one performance parameter, e.g., wear resistance, may introduce a deleterious performance characteristic, i.e., gear tooth breakage in severe application or attack of elastomeric seals. It is desirable to find a polysulfide which, when used alone or in combination with other additives, provides good extreme pressure properties to lubricants without adverse effects.

Different types of base stocks have different performance characteristics. Ester base stocks, for example, the neopentyl polyol esters such as the pentaerythritol esters of monobasic carboxylic acids, have excellent high performance properties as indicated by their common use in gas turbine lubricants. They also provide excellent anti-wear characteristics when conventional anti-wear additives are present and they do not have any adverse effect on the performance of rust inhibitors. On the other hand, esters have relatively poor hydrolytic stability, undergoing hydrolysis readily in the presence of water at even moderate temperatures. They are, therefore, less well suited for use in wet applications such as papermaking machinery.

Hydrolytic stability can be improved by the use of hydrocarbon base stocks. The use of alkyl aromatics in combination with the other hydrocarbon base stocks such as hydrogenated polyalphaolefin (PAO) synthetic hydrocarbons and the improved hydrolytic stability of these combinations is described, for example, in U.S. Pat. No. 5,602,086, corresponding to EP 496 486. Traditional formulations containing PAOs, however, present other performance problems. Although the hydrolytic stability of hydrocarbon base stocks, including PAOs is superior to that of the esters, it is frequently difficult to obtain a good balance of the surface-related properties such as anti-wear and anti-rust because, as noted above, these surface-related properties are dependent upon the extent to which the additives present in the base stock compete for sites on the metal surfaces which they are intended to protect and high quality hydrocarbon base stocks such as PAOs do not favorably interact with the additives used for this purpose. It is therefore a continuing problem to produce a good combination of surface-related properties including anti-wear performance and anti-rust performance in synthetic oils based on hydrocarbon base stocks such as PAOs.

A need exists for a polysulfide additive that provides improved performance characteristics for a finished lubricant composition comprising the polysulfide additive. A need exists for a polysulfide additive that improves at least one performance characteristic of a finished lubricant while reducing at least one of the deleterious effects caused by the use of a polysulfide additive in a finished lubricant.

SUMMARY OF THE INVENTION

The present invention relates to lubricating oil compositions, including dihydrocarbyl polysulfides, which are especially adapted for use in mechanical systems where gears are subjected to great stress and extremely high pressures such as those found in automotive rear axles or off highway transmissions and gear boxes. The present invention relates to lubricants and functional fluids, having a dihydrocarbyl polysulfide, that are useful particularly in environments characterized by high pressure and rubbing surfaces.

One embodiment according to the present invention includes a lubricating composition comprising a major amount of an oil of lubricating viscosity, at least one dihydrocarbyl polysulfide comprising less than about 88% dihydrocarbyl trisulfide; and a phosphorous compound or a boron compound, or mixtures of phosphorous compounds and boron compounds. The oil of lubricating viscosity is generally in a major amount when the oil is about 70 wt. % or greater of the total lubrication composition, preferably when the oil is about 90 wt. % or greater of the total lubrication composition.

Another embodiment according to the present invention further includes the polysulfide having at least about 7.5 wt. % dihydrocarbyl tetrasulfide or higher polysulfides.

One embodiment of the present invention includes a complex mixture of organic sulfides forming an additive that includes a monosulfide having the formula $R—S—R_1$, where R and $R_1$ may independently be a hydrocarbyl group as described below and a polysulfide having the formula $R_2—S_X—R_3$, wherein $R_2$ and $R_3$ may independently be a hydrocarbyl group as described below and X is equal to or greater than about 2. The ratio of $R—S—R_1$ to polysulfides, wherein X is equal to or greater than about 4, ranges from about 0.087 to about 0.112.

Another embodiment of the present invention is a lubricant oil composition containing the polysulfide additive and an oil or base stock of lubricating viscosity in which the base stock may be a mineral oil or a synthetic base stock.

Another embodiment according to the present invention includes a lubricating composition including a major amount of an oil of lubricating viscosity, at least one dihydrocarbyl polysulfide having less than about 88% dihydrocarbyl trisulfide, less than about 5.5 wt. % dihydrocarbyl disulfide; at least about 7.5 wt. % dihydrocarbyl tetrasulfide or higher polysulfides; and a phosphorous compound or a boron compound, or mixtures thereof.

Another embodiment according to the present invention includes a concentrate comprising from 0.1% to 49.9% by weight of a substantially inert, organic diluent and at least one dihydrocarbyl polysulfide comprising less than about 88% dihydrocarbyl trisulfide, less than about 5.5 wt. % dihydrocarbyl disulfide, at least about 7.5 wt. % dihydrocarbyl tetrasulfide or higher polysulfides and at least one phosphorus or boron compound or mixtures thereof.

Another embodiment according to the present invention includes a grease composition comprising at least one oil of lubricating viscosity, at least one thickening agent, and at least one dihydrocarbyl polysulfide comprising less than about 88% dihydrocarbyl trisulfide, less than about 5.5 wt. % dihydrocarbyl disulfide, and at least about 7.5 wt. % dihydrocarbyl tetrasulfide or higher polysulfides; and at least one phosphorus or boron compound, or mixtures thereof.

Another embodiment of the present invention includes the polysulfide additive, a mineral oil, alkyl phosphate/phosphite ester, a detergent or dispersant, borated alkylsuccinimide, primary amine, heterocyclic copper passivator, and a defoamant.

DETAILED DESCRIPTION OF THE INVENTION

The invention described herein includes polysulfide additives that provide improved performance characteristics, such as extreme pressure protection, when used in lubricating compositions; greases; and concentrates, and methods for the use thereof.

The term "hydrocarbyl" includes hydrocarbon, as well as substantially hydrocarbon groups. "Substantially hydrocarbon" describes groups which contain heteroatom substituents that do not substantially alter the predominantly hydrocarbon nature of the substituent. Non-limiting examples of hydrocarbyl groups include the following: (1) hydrocarbon substituents, i.e., aliphatic (e.g., alkyl or alkenyl) and alicyclic (e.g., cycloalkyl, cycloalkenyl, etc.) substituents, aromatic-, aliphatic-, and alicyclic-substituted aromatic substituents and also includes cyclic substituents wherein the ring is completed through another portion of the molecule (that is, for example, any two indicated substituents may together form an alicyclic radical); (2) substituted hydrocarbon substituents, i.e., those substituents containing non-hydrocarbon groups which do not substantially alter the predominantly hydrocarbon nature of the substituent and which includes groups such as, e.g., halo (especially chloro and fluoro), hydroxy, mercapto, nitro, nitroso, and sulfoxy; (3) heteroatom substituents, i.e., substituents which will contain an atom other than carbon in a ring or chain otherwise composed of carbon atoms (e.g., alkoxy or alkylthio). Suitable heteroatoms include, for example, sulfur, oxygen, nitrogen and such substituents containing one or more heteroatoms exemplified by, pyridyl, furyl, thienyl, and imidazolyl.

In general, no more than about 2, preferably no more than one heteroatom substituent will be present for every ten carbon atoms in the hydrocarbyl group. Typically, there will be no heteroatom substituents in the hydrocarbyl group in which case the hydrocarbyl group is a hydrocarbon. A preferred hydrocarbyl group is tertiary butyl.

As described above, the present invention relates to compositions containing at least one polysulfide having specific proportions of monosulfides and/or polysulfides in combination with at least one phosphorus or boron compound, or mixtures thereof In one embodiment, the organic polysulfide is present in a base stock at concentrations, based on the weight of the fully formulated lubricant composition, in the range of about 0.1% to about 10% by weight, or from about 0.2% up to about 8%, or from about 0.3% up to about 7%, or from about 0.5% to about 5% by weight. Here, as well as elsewhere in the specification and claims, the range and ratio limits may be combined. In one embodiment, the phosphorus or boron compound, or mixture thereof is present in an amount from about 0.05% up to about 10%, or from about 0.08% up to about 8%, or from about 0.1% up to about 5% by weight.

Organic Polysulfide

The dihydrocarbyl polysulfide is a mixture including less than about 88 wt. % dihydrocarbyl trisulfide, from about 4 wt. % to about 6 wt. % dihydrocarbyl disulfide, and from about 7 wt. % to about 10 wt. % dihydrocarbyl tetrasulfide or higher polysulfides. Preferably, the dihydrocarbyl polysulfide mixture includes less than about 85 wt. % dihydrocarbyl trisulfide. The term "polysulfide" as used herein may also include minor amounts of dihydrocarbyl monosulfides, also referred to monosulfide or sulfide. Generally, the monosulfide is present in relatively small amounts of less than about 1 wt. % of the total sulfur-containing compounds present. In one embodiment according to the present invention, the amount of trisulfide is at least less than about 88 wt. %. In another embodiment according to the present invention, the amount of dihydrocarbyl disulfide is more than about 4 wt. %, preferably more than about 5 wt. %. Typically, monosulfides may be present in amounts ranging from about 0.3 wt. % to about 0.4 wt. %. The monosulfides are preferably less than about 0.4 wt. % and more preferably less than about 0.3 wt. %.

The compositions of two non-limiting, exemplary polysulfide mixtures, as determined by gas chromatography and reported as weight % of the total sulfur-containing compounds, are shown below in Table 1:

TABLE 1

Polysulfide Compositions

| Example | Light Ends | S1 (mono-sulfide) | S2 (disulfide) | S3 (trisulfide) | S4 (tetrasulfide or higher polysulfides) |
|---|---|---|---|---|---|
| A | 0.03 | 0.36 | 5.35 | 84.82 | 9.46 |
| B | 0.02 | 0.28 | 4.37 | 87.70 | 7.62 |

The sulfide analysis is performed on a Varian 6000 Gas Chromatograph and FID detector SP-4100 computing integrator. The column is a 25 m. Megabore SGE BP-1. The temperature profile is 75° C., hold time of 2 min., then heat to 250° C. at a rate of 6° C./min. The helium flow is 6.0 ml/min plus make-up. The injection temperature is 40° C. and the detector temperature is 260° C. The injection size is 0.6 $\mu$l. References are the monosulfide, disulfide and trisulfide analogues to the sulfur composition for analysis. The references may be obtained by fractionating the product to form sulfide fractions (S1, S2 and S3) to be used for analysis. The procedure for analysis is as follows: (1) An area % determination is conducted on each reference sample to determine its purity. (2) An area % determination is conducted on the sample to be tested to get an approximate value of its composition. (3) A calibration blend is accurately weighed based on the area % results of the sample to be tested; then the internal standard toluene is added to the blend in an amount equal to approximately one-half of the weight of the largest component. This provides an area approximately the same as that of the largest component. (4) The weights of each component (i.e., S1, S2 and S3) are corrected by the % purity from step 1. (5) The calibration blend is analyzed in triplicate using the corrected weights and then calculated, using the following formula, to reflect the multiple peaks in S1 and S2:

$$RF = \frac{\text{(concentration of components*)}}{\text{(total area of peaks)}} \frac{\text{(area of internal standard)}}{\text{(concentration of internal standard)}}$$

*Adjusted for purity of the standard, i.e., component weight times percent purity equals concentration of component (6) These response factors, plus the response factor for the single S3 peak, are used for determining weight percent results for the samples to be tested. (7) Results for S1 and S2 are adjusted to include all the peaks attributed to them. (8) Higher polysulfides are determined by difference using the following formula:

$$S4=100\%-(S1+S2+S3+\text{light ends})$$

Light ends are defined as any peaks eluted prior to the internal standard.

The organic polysulfide generally has hydrocarbyl groups each independently having from about 2 to about 30 carbon atoms, preferably from about 2 to about 20, or from about 2 to about 12 carbon atoms. The hydrocarbyl groups may be aromatic or aliphatic, preferably aliphatic. In one embodiment according to the present, the hydrocarbyl groups are alkyl groups. In a specific embodiment according to the present invention, the hydrocarbyl groups are t-butyl.

The organic polysulfides may be derived from an olefin or a mercaptan. The olefins, which may be sulfurized, contain at least one olefinic, i.e., a non-aromatic, double bond. Olefins having from 2 to about 30 carbon atoms, or from about 3 to about 16 (most often less than about 9) carbon atoms are particularly useful. Olefins having from 2 to about 5, or from 2 to about 4 carbon atoms are particularly useful. Isobutylene, propylene and their dimers, trimers and tetramers, and mixtures thereof are especially preferred olefins. Of these compounds, isobutylene and diisobutylene are preferred.

The mercaptans used to make the polysulfide may be hydrocarbyl mercaptans, such as those represented by the formula R—S—H, wherein R is a hydrocarbyl group as defined above. In one embodiment according to the present invention, each R is independently an alkyl, an alkenyl, cycloalkyl, or cycloalkenyl group. Each R independently may be a haloalkyl, hydroxyalkyl, or hydroxyalkyl substituted (e.g., hydroxymethyl, hydroxyethyl, etc.) aliphatic group. R generally contains from about 2 to about 30 carbon atoms, or from about 2 to about 24 carbon atoms, or from about 3 to about 18 carbon atoms. Examples include, but are not limited to, butyl mercaptan, amyl mercaptan, hexyl mercaptan, octyl mercaptan, 6-hydroxymethyloctanethiol, nonyl mercaptan, decyl mercaptan, 10-aminododecanethiol, dodecyl mercaptan, 10-hydroxymethyl-tetradecanethiol, and tetradecyl mercaptan.

The dihydrocarbyl polysulfide may be prepared by reacting, optionally under superatmospheric pressure, one or more of the above olefins with a mixture of sulfur and hydrogen sulfide in the presence, or absence, of a catalyst, such as an alkyl amine catalyst, followed by removal of low boiling materials. The olefins which may be sulfurized, the sulfurized olefin, and methods of preparing the same are described in U.S. Pat. Nos. 4,119,549; 4,191,659; and 4,344,854. The disclosure of these patents is hereby incorporated by reference for its description of the sulfurized olefins and preparation of the same.

The following examples relate to polysulfide additives according to the present invention and methods of making the same.

The compositions of Examples A and B, shown in Table 1, may be prepared from olefins using the methods described above or, alternatively, may be prepared by blending polysulfide containing materials.

Example A may be obtained by blending a trisulfide such as TBPS 344, commercially available from ChevronPhillips, and a polysulfide mixture such as MOBILAD™ C170, commercially available from ExxonMobil, in a 75:25 ratio by weight. Example B may be obtained by blending TBPS 344 and MOBILAD™ C170 in an 80:20 ratio by weight. Blending of TBPS 344 and MOBILAD™ C 70 may be accomplished by any conventional method.

As described above, the lubricating compositions, concentrates and greases additionally contain at least one phosphorus or boron compound, or mixtures of two or more thereof. The phosphorus and boron compounds are described in more detail below.

Phosphorus Compounds

The lubricating compositions, concentrates, and greases may include a phosphorus compound. The phosphorus compound is selected from a metal dithiophosphate, a phosphoric acid ester or salt thereof, a reaction product of a phosphite and sulfur or a source of sulfur, a phosphite, a reaction product of a phosphorus acid or anhydride and an unsaturated compound, and mixtures of two or more thereof. Typically, the phosphorus containing anti-wear/extreme pressure agent is present in the lubricants and functional fluids at a level from about 0.01% to about 10%, or from about 0.05% or to about 4%, or from about 0.08% to about 3%, or from 0.1% to about 2% by weight.

The metal thiophosphates are prepared by reacting a metal base with one or more thiophosphorus acids. The thiophosphorus acid may be prepared by reacting one or more phosphorus sulfides, which include phosphorus pentasulfide, phosphorus sesquisulfide, phosphorus heptasulfide and the like, with one or more alcohols. The thiophosphorus acid may be mono- or dithiophosphorus acid. The alcohols generally contain from 1 to about 30 carbon atoms, or from 2 to about 24 carbon atoms, or from about 3 to about 12 carbon atoms, or from about 3 to about 8 carbon atoms. Alcohols used to prepare the thiophosphoric acids include propyl, butyl, amyl, 2-ethylhexyl, hexyl, octyl, oleyl, and cresol alcohols.

In one embodiment, the phosphorus acid is a thiophosphoric acid, preferably a monothiophosphoric acid. Thiophosphoric acids may be prepared by the reaction of a sulfur source with a dihydrocarbyl phosphite. The sulfur source may be, for instance, elemental sulfur, or a sulfide, such as a sulfur coupled olefin or a sulfur coupled dithiophosphate. Elemental sulfur is a preferred sulfur source. The preparation of monothiophosphoric acids is disclosed in U.S. Pat. No. 4,755,311 and PCT Publication WO 87/07638, which are incorporated herein by reference for their disclosure of monothiophosphoric acids, sulfur sources, and the process for making monothiophosphoric acids. Monothiophosphoric acids may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C., or higher) to form the monothiophosphoric acid.

In another embodiment, the phosphorus acid is a dithiophosphoric acid or phosphorodithioic acid. The dithiophosphoric acid may be represented by the formula $(R_4O)_2PSSH$, wherein each $R_4$ is independently a hydrocarbyl group, containing from about 3 to about 30 carbon atoms, or from about 3 to about 18, or from about 4 to about 12, or to about 8 carbon atoms. Non-limiting examples of $R_4$ include isopropyl, isobutyl, n-butyl, sec-butyl, amyl, n-hexyl, methylisobutyl carbinyl, heptyl, 2-ethylhexyl, isooctyl, nonyl, behenyl, decyl, dodecyl, tridecyl, alkylphenyl groups, or mixtures thereof. Illustrative lower alkylphenyl $R_4$ groups include butylphenyl, amylphenyl, and heptylphenyl and mixtures thereof. Examples of mixtures of $R_4$ groups include, but are not limited to: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

The metal thiophosphates are prepared by the reaction of a metal base with the thiophosphorus acid. The metal base may be any metal compound capable of forming a metal salt. Non-limiting examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals, and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper or zinc. Examples of metal compounds that may be reacted with the phosphorus acid include, but are not limited to, zinc hydroxide, zinc oxide, copper hydroxide, copper oxide, etc.

Examples of metal dithiophosphates include, but are not limited to, zinc isopropyl, methylamyl dithiophosphate, zinc isopropyl iscoctyl dithiophosphate, barium di(nonyl) dithiophosphate, zinc di(cyclohexyl) dithiophosphate, copper di(isobutyl) dithiophosphate, calcium did(hexyl) dithiophosphate, zinc isobutyl isoamyl dithiophosphate, and zinc isopropyl secondary-butyl dithiophosphate.

In one embodiment according to the present invention, the phosphorus compound is a phosphorus acid ester. The ester is prepared by reacting one or more phosphorus acids or anhydrides with an alcohol containing from one to about 30 carbon atoms, or from two to about 24, or from about 3 to about 12 carbon atoms. The alcohols used to prepare the phosphorus acid esters include those described above for metal thiophosphates. The phosphorus acid or anhydride is generally an inorganic phosphorus reagent, such as phosphorus pentoxide, phosphorus trioxide, phosphorus tetroxide, phosphorous acid, phosphoric acid, phosphorus halide, $C_{1-7}$ phosphorus esters, or one of the above described phosphorus sulfides. In one embodiment, the phosphorus acid is a thiophosphorus acid or salt thereof. The thiophosphoric acids and their salts are described above. Non-limiting examples of phosphorus acid esters include phosphoric acid di- and tri-esters prepared by reacting a phosphoric acid or anhydride with cresol alcohols, e.g., tricresylphosphate.

In another embodiment according to the present invention, the phosphorus compound is a phosphorus ester prepared by reacting one or more dithiophosphoric acids with an epoxide or a glycol. This reaction product may be used alone, or further reacted with a phosphorus acid, anhydride, or lower ester. The epoxide is generally an aliphatic epoxide or a styrene oxide. Examples of useful epoxides include, but are not limited to, ethylene oxide, propylene oxide, butene oxide, octene oxide, dodecene oxide, styrene oxide, etc. Propylene oxide is preferred. The glycols may be aliphatic glycols, having from 1 to about 12 carbon atoms, or from about 2 to about 6, or from about 2 to about 3 carbon atoms, or aromatic glycols. Glycols include, but are not limited to, ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

Acidic phosphoric acid esters may be reacted with ammonia, an amine, or metallic base to form an ammonium or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition. When the phosphorus acid esters are acidic, they may be reacted with ammonia, an amine, or metallic base to form the corresponding ammonium or metal salt. The salts may be formed separately and then the salt of the phosphorus acid ester added to the lubricating or functional fluid composition. Alternatively, the salts may also be formed when the phosphorus acid ester is blended with other components to form the lubricating or functional fluid composition. The phosphorus acid ester may then form salts with basic materials that are in the lubricating composition or functional fluid composition such as basic nitrogen containing compounds (e.g., acylated amines).

The ammonium salts of the phosphorus acid esters may be formed from ammonia, or an amine, or mixtures thereof. These amines can be monoamines or polyamines. Useful amines include those disclosed in U.S. Pat. No. 4,234,435 at col. 21, line 4 to col. 27, line 50, this section of this reference being incorporated herein by reference.

The monoamines generally have at least one hydrocarbyl group containing from 1 to about 30 carbon atoms, with from 1 to about 20 carbon atoms being preferred, with from 1 to about 16 being more preferred. Non-limiting examples of monoamines include methylamine, ethylamine, propylamine, butylamine, 2-ethylhexylamine, octylamine, and dodecylamine. Non-limiting examples of secondary amines include dimethylamine, diethylamine, dipropylamine, dibutylamine, methylbutylamine, ethylhexylamine, etc. Tertiary amines include, but are not limited to, trimethylamine, tributylamine, methyldiethylamine, ethyldibutylamine, etc.

In one embodiment according to the present invention, the amine is a tertiary-aliphatic primary amine. Generally, the aliphatic group, preferably an alkyl group, contains from about 4 to about 30 carbon atoms, or from about 6 to about 24, or from about 8 to about 22 carbon atoms. Usually the tertiary alkyl primary amines are monoamines represented by the formula $R_5$—$C(R_6)_2$—$NH_2$, wherein $R_5$ is a hydrocarbyl group containing from 1 to about 27 carbon atoms and $R_6$ is a hydrocarbyl group containing from 1 to about 12 carbon atoms. Such amines are illustrated by t-butylamine, t-hexylamine, 1-methyl-1-amino-cyclohexane, t-octylamine, t-decylamine, t-dodecylamine, t-tetradecylamine, t-hexadecylamine, t-octadecylamine, t-tetracosanylamine, and t-octacosanylamine.

Mixtures of tertiary aliphatic amines may also be used. Illustrative of amine mixtures of this type are "Primene™ 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary aliphatic primary amines and methods for their preparation are known to those of ordinary skill in the art. The tertiary aliphatic primary amines are described in U.S. Pat. No. 2,945,749, which is hereby incorporated by reference for its teaching in this regard.

In another embodiment according to the present invention, the amine may be a hydroxyamine. Typically, the hydroxyamines are primary, secondary or tertiary alkanol amines or mixtures thereof. Such amines can be represented by the formulae: $H_2$—N—R'—OH, H($R'_1$)N—R'—OH, and $(R'_1)_2$—N—R'—OH, wherein each $R'_1$ is independently a hydrocarbyl group having from 1 to about 8 carbon atoms or a hydroxyhydrocarbyl group having from 1 to about 8 carbon atoms, or from 1 to about 4 carbon atoms, and R' is a divalent hydrocarbyl group of about 2 to about 18 carbon atoms, or from 2 to about 4. The group —R'—OH in such formulae represents the hydroxyhydrocarbyl group. R' can be an acyclic, alicyclic or aromatic group. Typically, R' is an acyclic straight or branched alkylene group such as an ethylene, propylene, 1,2-butylene, 1,2-octadecylene, etc., group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl, or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl)amines can be conveniently prepared by reaction of one or more of the above epoxides with aforedescribed amines and may be represented by the formulae: $H_2N$—$(R'O)_x$—H (VIII), H($R'_1$)—N—$R'O)_x$—H (IX), and $(R'_1)_2$—N—$(R'O)_x$—H (X), wherein x is a number from about 2 to about 15 and $R_1$; and R' are as described above. $R'_1$ may also be a hydroxypoly(hydrocarbyloxy) group.

In another embodiment, the amine is a hydroxyamine which may be represented by the formula wherein $R_1$ is a hydrocarbyl group containing from about 6 to about 30 carbon atoms; $R_2$ is an alkylene group having from about 2 to about 12 carbon atoms, preferably an ethylene or propylene group; $R_3$ is an alkylene group containing from 1 to about 8, or from 1 to about 5 carbon atoms; y is zero or one; and each z is independently a number from zero to about 10, with the proviso that at least one z is zero. Useful hydroxyhydrocarbyl amines where y in the above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

The amine may also be a polyamine. The polyamines include alkoxylated diamines, fatty diamines, described above, alkylenepolyamines (described above), hydroxy containing polyamines, condensed polyamines, described above, and heterocyclic polyamines, described above. Commercially available examples of alkoxylated diamines include those amines where y in the above formula is one.

In another embodiment, the polyamine is a fatty diamine. The fatty diamines include mono- or dialkyl, symmetrical or asymmetrical ethylenediamines, propanediamines (1,2 or 1,3), and polyamine analogs of the above.

In another embodiment, the amine is an alkylenepolyamine. Alkylenepolyamines are represented by the formula HRN-(Alkylene-N)$_n$(R)$_2$, wherein each R is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_{28}$ is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from 2 to about 20 carbon atoms, or from 2 to about 4 carbon atoms. Examples of polyhydric amines include tri-(hydroxypropyl)amine, tris-(hydroxymethyl)amino methane, 2-amino-2-methyl-1, 3-propanediol, N,N,N',N'-tetrakis (2-hydroxypropyl) ethylenediamine, and N,N,N',N'-tetrakis (2-hydroxyethyl) ethylenediamine, preferably tris(hydroxymethyl) aminomethane (THAM).

Polyamines that may react with the polyhydric alcohol or amine to form the condensation products or condensed amines are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 and U.S. Pat. No. 5,230,714 (Steckel), which are incorporated by reference for its disclosure to the condensates and methods of making In another embodiment, the polyamines are polyoxyalkylene polyamines, e.g., polyoxyalkylene diamines and polyoxyalkylene triamines, having average molecular weights ranging from about 200 to about 4,000, or from about 400 to about 2,000. The preferred polyoxyalkylene polyamines include the polyoxyethylene and polyoxypropylene diamines and the polyoxypropylene triamines.

In another embodiment, the polyamines are hydroxy-containing polyamines. Hydroxy-containing polyamine analogs of hydroxy monoamines, particularly alkoxylated alkylenepolyamines, e.g., N,N-(diethanol)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary, or tertiary alkanol amines with ethylene, propylene or higher epoxides in a 1:1 to 1:2 molar ratio. Reactant ratios and temperatures for carrying out such reactions are known to those skilled in the art. Specific examples of hydroxy-containing polyamines include N-(2-hydroxyethyl) ethylenediamine, N,N'-bis(2-hydroxyethyl) ethylenediamine, 1-(2-hydroxyethyl)piperazine, mono (hydroxypropyl)-substituted tetraethylenepentamine, N-(3-hydroxybutyl)-tetramethylene diamine, etc. Higher homologs obtained by condensation of the above-illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above-described polyamines are also useful.

In another embodiment, the amine is a heterocyclic amine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic amines are also useful. Examples include N-(2-hydroxyethyl)cyclohexylamine, 3-hydroxycyclopentylamine, parahydroxyaniline, N-hydroxyethylpiperazine, and the like.

Hydrazine and hydrocarbyl-substituted hydrazine may also be used to form the acylated nitrogen dispersants. At least one of the nitrogen atoms in the hydrazine must contain a hydrogen directly bonded thereto. Preferably there are at least two hydrogens bonded directly to hydrazine nitrogen and, more preferably, both hydrogens are on the same nitrogen. Specific examples of substituted hydrazines are methylhydrazine, N,N-dimethyl hydrazine, N,N'-dimethyl hydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methylhydrazine, N,N'-di(para-chlorophenol)-hydrazine, N-phenyl-N'-cyclohexylhydrazine, and the like.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, borates, or the like. The metals of the metal base include Group IA, IIA, IB through VIIB, and VIII metals (CAS version of the Periodic Table of the Elements). These metals include the alkali metals, alkaline earth metals, and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper, or zinc. Examples of metal compounds that may be reacted with the phosphorus acid include zinc hydroxide, zinc oxide, copper hydroxide, copper oxide, etc.

In another embodiment, the phosphorus compound is a metal thiophosphate, preferably a metal dithiophosphate. The metal thiophosphates are described above. In another embodiment, the metal dithiophosphates are further reacted with one or more of the above described epoxides, preferably propylene oxide. These reaction products are described in U.S. Pat. Nos. 3,213,020; 3,213,021; and 3,213,022, issued to Hopkins et al. These patents are incorporated by reference for such description of the reaction products.

In another embodiment, the phosphorus compound may be a phosphite. In one embodiment, the phosphite is a di- or trihydrocarbyl phosphite. Preferably each hydrocarbyl group has from 1 to about 24 carbon atoms, more preferably from 1 to about 18 carbon atoms, and more preferably from about 2 to about 8 carbon atoms. Each hydrocarbyl group may be independently alkyl, alkenyl, aryl, and mixtures thereof. When the hydrocarbyl group is an aryl group, then it contains at least about 6 carbon atoms; preferably about 6 to about 18 carbon atoms. Non-limiting examples of the alkyl or alkenyl groups include propyl, butyl, hexyl, heptyl, octyl, oleyl, linoleyl, stearyl, etc. Examples of aryl groups include, but are not limited to, phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl, oleyl, or phenyl. Phosphites and their preparation are known and many phosphites are available commercially. Particularly useful phosphites are dibutyl hydrogen phosphite, dioleyl hydrogen phosphite, di($C_{14-18}$) hydrogen phosphite, and triphenyl phosphite.

In one embodiment, the phosphorus compound may be a reaction product of a phosphorus acid and an unsaturated compound. The unsaturated compounds include unsaturated amides, esters, acids, anhydrides, and ethers. The phosphorus acids are described above; preferably the phosphorus acid is a dithiophosphoric acid. In one embodiment, the unsaturated compound is an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde, to form coupled compounds. The phosphorus-containing amides are known in the art and are disclosed in U.S. Pat. Nos. 4,876,374; 4,770,807; and 4,670,169 that are incorporated by reference for their disclosures of phosphorus amides and their preparation.

In one embodiment, the unsaturated compound, an unsaturated carboxylic acid or ester, such as a vinyl or allyl acid or ester. If the carboxylic acid is used, the ester may then be formed by subsequent reaction with an alcohol. In one embodiment, the unsaturated carboxylic acids include the unsaturated fatty acids and esters described above. The vinyl ester of a carboxylic acid may be represented by the formula $RCH{=}CH{-}O(O)CR^1$, wherein R is a hydrogen or hydrocarbyl group having from 1 to about 30 carbon atoms, preferably hydrogen or a hydrocarbyl group having 1 to about 12, more preferably hydrogen, and $R^1$ is a hydrocarbyl group having 1 to about 30 carbon atoms, preferably 1 to about 12 carbon atoms, more preferably 1 to about 8 carbon atoms. Examples of vinyl esters include, but are not limited to, vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula $RO{-}(O)C{-}HC{=}CH{-}C(O)OR$, wherein each R is independently a hydrocarbyl group having 1 to about 18 carbon atoms, preferably 1 to about 12, more preferably 1 to about 8 carbon atoms. Non-limiting examples of unsaturated carboxylic esters, useful in the present invention, include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus compound is the reaction product of a phosphorus acid and a vinyl ether. The vinyl ether is represented by the formula $R{-}CH_2{=}CH{-}OR^1$, wherein R is hydrogen or a hydrocarbyl group having 1 to about 30 carbon atoms, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include, but are not limited to, vinyl methylether, vinyl propylether, vinyl 2-ethylhexylether and the like.

Boron-Containing Anti-Wear/Extreme Pressure Agents

The lubricants and/or functional fluids may additionally contain a boron compound. Typically, the boron-containing anti-wear/extreme pressure agent is present in the lubricants and functional fluids at a level from about 0.01% up to about 10%, or from about 0.05% or up to about 4%, or from about 0.08% up to about 3%, or from 0.1% to about 2% by weight. Non-limiting examples of boron-containing anti-wear/extreme pressure agents include a borated dispersant; an alkali metal or a mixed alkali metal, alkaline earth metal borate; a borated epoxide; and a borate ester.

In one embodiment, the boron compound is a borated dispersant. Borated dispersants are prepared by reaction of one or more dispersants with one or more boron compounds. The dispersants include, but are not limited to, acylated amines, carboxylic esters, Mannich reaction products, hydrocarbyl-substituted amines, and mixtures thereof. The acylated amines include reaction products of one or more of the above carboxylic acylating agents and one or more amines. The amines may be any of those described above, preferably a polyamine, such as an alkylenepolyamine or a condensed polyamine.

Acylated amines and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents are hereby incorporated by reference.

In another embodiment, the dispersant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl-substituted amines are prepared by reacting olefins and olefin polymers, including the above polyalkenes and halogenated derivatives thereof, with amines (mono- or polyamines). The amines may be any of the amines described above, preferably an alkylenepolyamine. Non-limiting examples of hydrocarbyl-substituted amines include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene)trimethylenediamine; N-poly(butene)diethylenetriamine; N',N'-poly(butene)tetraethylenepentamine; N,N-dimethyl-N'-poly(propylene)-1,3-propylenediamine and the like.

In another embodiment, the dispersant may also be a Mannich dispersant. Mannich dispersants are generally formed by the reaction of at least one aldehyde, such as formaldehyde and paraformaldehyde, at least one of the above-described amines and at least one alkyl-substituted hydroxyaromatic compound. The reaction may occur from room temperature to about 225° C., or from about 50° C. to about 200° C., or from about 75° C. to about 150° C. The amounts of the reagents are such that the molar ratio of hydroxyaromatic compound to formaldehyde to amine is in the range from about (1:1:1) to about (1:3:3).

The first reagent is an alkyl-substituted hydroxyaromatic compound. This term includes the above-described phenols. The hydroxyaromatic compounds are those substituted with at least one, and preferably not more than two, aliphatic or alicyclic groups having from about 6 to about 400 carbon atoms, or from about 30 to about 300, or from about 50 to about 200 carbon atoms. These groups may be derived from one or more of the above described olefins or polyalkenes. In one embodiment, the hydroxyaromatic compound is a phenol substituted with an aliphatic or alicyclic hydrocarbon-based group having a number average molecular weight, Mn, of about 420 to about 10,000.

The third reagent is any amine described above containing at least one NH group. Preferably the amine is one or more of the above-described polyamines, such as the polyalkylenepolyamines. Mannich dispersants are described in the following patents: U.S. Pat. Nos. 3,980,569; 3,877,899; and 4,454,059 (herein incorporated by reference for their disclosure to Mannich dispersants).

In another embodiment, the dispersant is a borated dispersant. The borated dispersants are prepared by reacting one or more of the above dispersants with one or more of the above-described boron compounds.

Typically, the borated dispersant contains from about 0.1% to about 5%, or from about 0.5%- to about 4%, or from 0.7% to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662; and 4,925,983. These references are incorporated by reference for their disclosure of borated dispersants.

In one embodiment, the boron compound is an alkali or an alkali metal and alkaline earth metal borate. These metal borates are generally hydrated particulate metal borates that are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790. These patents are incorporated by reference for their disclosures of the metal borates and methods of their manufacture.

In another embodiment, the boron compound is a borated fatty amine. The borated amines are prepared by reacting one or more of the above boron compounds with one or more of the above fatty amines, e.g., an amine having from about 4 up to about 18 carbon atoms. The borated fatty amines are prepared by reacting the amine with the boron compound from about 50° C. to about 300° C., preferably from about 100° C. to about 250° C., and at a ratio from about 3:1 to about 1:3 equivalents of amine to equivalents of boron compound.

In another embodiment, the boron compound is a borated epoxide. The borated fatty epoxides are generally the reaction product of one or more of the above boron compounds with at least one epoxide. The epoxide is generally an aliphatic epoxide having from 8 up to about 30 carbon atoms, preferably from about 10 up to about 24 carbon atoms, more preferably from about 12 up to about 20 carbon atoms. Examples of useful aliphatic epoxides include heptyl epoxide, octyl epoxide, oleyl epoxide and the like. Mixtures of epoxides may also be used, for instance, commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides ad methods for preparing the same.

In one embodiment, the boron compound is a borate ester. The borate esters may be prepared by reacting one or more of the above boron compounds with one or more of the above alcohols. Typically, the alcohols contain from about 6 up to about 30 carbon atoms, or from about 8 to about 24 carbon atoms. The methods of making such borate esters are known to those in the art.

Lubricants

As previously indicated, the combination of a dihydrocarbyl polysulfide and a phosphorus or boron compound, or mixture thereof are useful as additives for lubricants in which they can function primarily as anti-wear, anti-weld, and/or extreme pressure agents. Lubricants containing this combination have improved properties such as those relating to odor, copper strip, thermal stability wear, scuffing, oxidation, surface fatigue, seal compatibility, corrosion resistance, and thermal durability. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

As described above, the lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalphaolefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such as a polyolefin. A description of oils of lubricating viscosity occurs in U.S. Pat. No. 4,582,618 (col. 2, line 37 through col. 3, line 63, inclusive), herein incorporated by reference for its disclosure to oils of lubricating viscosity.

Synthetic hydrocarbon base stocks include the polyalphaolefins (PAOs). The PAOs are known materials and typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-decene and poly-1-dodecene although the dimers of higher olefins in the range of $C_{14}$ to $C_{18}$ provide low viscosity base stocks.

The PAO fluids may be conveniently made by the polymerization of an alpha-olefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,910,355 (Shubkin); U.S. Pat. No. 4,956,122 (Watts); and, U.S. Pat. No. 5,068,487 (Theriot). A particularly favorable class of PAO type base stocks are the High Viscosity Index PAOs (HVI-PAOs) prepared by the action of a reduced chromium catalyst with the alpha-olefin; the HVI-PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and, U.S. Pat. No. 4,914,254 (Pelrine). The dimers of the $C_{14}$ to $C_{18}$ olefins are described in U.S. Pat. No. 4,218,330.

The average molecular weight of the PAO typically varies from about 250 to about 10,000 with a preferred range of from about 300 to about 3,000 with a viscosity varying from about 3 cSt to about 200 cSt at 100° C. The PAO, being the majority component of the formulation will have the greatest effect on the viscosity and other viscometric properties of the finished product. Since the finished lubricant products are sold by viscosity grade, blends of different PAOs may be used to achieve the desired viscosity grade. Typically, the PAO component will comprise one or more PAOs of varying viscosities, usually with the lightest component being nominally a 2 cSt (100° C.) component with other, more viscous PAOs also being present in order to give the final desired viscosity to the finished formulation. Typically, PAOs may be made in viscosities up to about 1,000 cSt (100° C.) although in most cases, viscosities greater than 100 cSt will not be required except in minor amounts as viscosity index improvers.

Additionally, alkylated aromatic compounds may be used as a base stock. The alkylated aromatic compounds include, but are not limited to, alkylated naphthalenes in which the alkyl group may be a hydrocarbyl group as described above. The base stock may also be from the class of hydrocarbon-substituted aromatic compounds, such as the long chain alkyl-substituted aromatics. The preferred hydrocarbon substituents for all these materials are, of course, the long chain alkyl groups with at least 8 and usually at least 10 carbon atoms, to confer good solubility in the primary hydrocarbon blend component. Alkyl substituents of 12 to 18 carbon atoms are suitable and can readily be incorporated by conventional alkylation methods using olefins or other alkylating agents. The aromatic portion of the molecule may be hydrocarbon or non-hydrocarbon as in the examples given below.

Included in this class of base stock are, for example, long chain alkylbenzenes and long chain alkylnaphthalenes which are particularly preferred materials since they are hydrolytically stable and may therefore be used alone or in combination with the PAO component of the base stock in wet applications. The alkylnaphthalenes are known materials and are described, for example, in U.S. Pat. No. 4,714,794 (Yoshida et al.). The use of a mixture of monoalkylated and polyalkylated naphthalene as a base for synthetic functional fluids is also described in U.S. Pat. No. 4,604,491 (Dressler). The preferred alkylnaphthalenes are those having a relatively long chain alkyl group typically from 10 to 40 carbon atoms although longer chains may be used if desired. Alkylnaphthalenes produced by alkylating naphthalene with an olefin of 14 to 20 carbon atoms have particularly good especially when zeolites such as the large pore size zeolites are used as the alkylating catalyst, as described in U.S. Pat. No. 5,602,086, corresponding to EP 496 486 to which reference is made for a description of the synthesis of these materials. These alkylnaphthalenes are predominantly monosubstituted naphthalenes with attachment of the alkyl group taking place predominantly at the 1- or 2-position of the alkyl chain. The presence of the long chain alkyl groups confers good viscometric properties on the alkylnaphthalenes, especially when used in combination with the PAO components which are themselves materials of high viscosity index, low pour point, and good fluidity.

An alternative blending stock, used alone or in combination with other base stocks, is an alkylbenzene or mixture of alkylbenzenes. The alkyl substituents in these fluids are typically alkyl groups of about 8 to 25 carbon atoms, usually from 10 to 18 carbon atoms and up to three such substituents may be present as described in ACS Petroleum Chemistry Preprint 1053–1058, "Poly n-Alkylbenzene Compounds: A Class of Thermally Stable and Wide Liquid Range Fluids", Eapen et al, Phila. 1984. Tri-alkyl benzenes may also be produced by the cyclodimerization of 1-alkynes of 8 to 12 carbon atoms as described in U.S. Pat. No. 5,055,626. Other alkylbenzenes are described in EP 168 534 and U.S. Pat. No. 4,658,072. Alkylbenzenes have been used as lubricant base stocks, especially for low temperature applications (Arctic vehicle service and refrigeration oils) and in papermaking oils. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, [R. L. Shubkin (Ed.)], Marcel Dekker, N.Y. 1993.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; 5,371,248; and EP 815187.

In one embodiment, the oil of lubricating viscosity is a polyalphaolefin (PAO). Typically, the polyalphaolefins are derived from monomers having from about 3 to about 30 carbon atoms, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins. Other suitable PAOs include ExxonMobil High Viscosity Index (HVI) PAOs, sold under the name SuperSyn™ PAO, having a viscosity ranging from about 150 to about 3,000 cSt at 100° C. Additionally, HVI SuperSyn™ PAO having viscosities ranging from about 300 to about 800 $KV_{100}$ are also suitable PAOs. Other suitable base stock components include, but are not limited to, mineral oil (Group I base stocks), hydroprocessed mineral oil (Group II and III base stocks), conventional PAO (Group IV base stocks), and esters (Group V base stocks).

Methods of preparing high VI base stocks are disclosed in U.S. Pat. Nos. 4,827,064, 4,827,073; 5,012,020; and 5,146,021,which are fully incorporated by reference.

In one embodiment, the oil of lubricating viscosity is selected to provide lubricating compositions with a kinematic viscosity of at least about 3.5 cSt, or at least about 4.0 cSt at 100° C. The viscosity grades for the final product may typically be in the range of ISO 20 to ISO 1,000 or even higher for gear lubricant applications, for example, up to about ISO 46,000. While the finished lubricant viscosity will be determined by the Viscosity Grades, one embodiment according to the present invention has finished fluids with viscosities in the range of from about 9 to about 41 cSt at 100° C. The viscosity grade of the final product is adjusted by suitable blending of base stock components of differing viscosities, together with the use of thickeners, if desired. Differing amounts of the various base stock components (primary hydrocarbon base stocks, secondary base stock and any additional base stock components) of different viscosities, may be suitably blended together to obtain a base stock blend with a viscosity appropriate for blending with the other components of the finished lubricant. In one embodiment, the lubricating compositions have an SAE gear viscosity grade of at least about SAE 70W. The lubricating composition may include a winter grade as low as 70W and a summer grade as high as 140W. The lubricating composition may include, but is not limited to, so-called multi-grade rating such as SAE 70W-80, 70W-85, 70W-90, 75W-140, 80W-90, 80W-140, 85W-90, or 85W-140. Multi-grade lubricants may include a viscosity improver that is formulated with the oil of lubricating viscosity to provide the above lubricant grades. Useful viscosity improvers include, but are not limited to, polyolefins, such as ethylene-propylene copolymers, or polybutylene rubbers, including hydrogenated rubbers, such as styrene-butadiene or styrene-isoprene rubbers; or polyacrylates, including polymethacrylates.

In one embodiment, the oil of lubricating viscosity includes at least one ester of a such as styrene-butadiene or styrene-isoprene rubbers; or polyacrylates, including dicarboxylic acid. Typically the esters containing from about 4 to about 30 carbon atoms, preferably from about 6 to about 24, or from about 7 to about 18 carbon atoms in each ester group. Here, as well as elsewhere, in the specification and claims, the range and ratio limits may be combined. N on-limiting examples of dicarboxylic acids include glutaric, adipic, pimelic, suberic, azelaic and sebacic. Examples of ester groups include, but are not limited to, hexyl, octyl, decyl, and dodecyl ester groups. The ester groups include linear, as well as branched ester groups such as iso arrangements of the ester group. A particularly useful ester of a dicarboxylic acid is diisodecyl azelate. Other useful esters include polyolesters.

The polyols include, but are not limited to, trimethylol propane and pentaerythritol.

The esters which may be used for this purpose include the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols, e.g., neopentyl glycol, trimethylol ethane, 2-methyl-2-propyl-1,3-propanediol, trimethylol propane, pentaerythritol and dipentaerythritol with alkanoic acids containing at least 4 carbon atoms exemplified by $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Esterex™ NP341 and NP344 esters (available from ExxonMobil Chemical Company).

A lubricating oil composition was prepared by mixing the materials listed in Table 1 with a base stock or blend of base stocks. The materials may be mixed by any conventional method.

TABLE 2

| Weight % of Typical Components of Additive Package | |
|---|---|
| Polysulfide Mixture A (Table 1) | about 20 wt. % to about 60 wt. % |
| Alkyl phosphate, Alkyl phosphite | about 3 wt. % to about 15 wt. % |
| Dispersant | about 5 wt. % to about 30 wt. % |
| Borated Dispersant | about 0 wt. % to about 10 wt. % |
| Amine | about 1 wt. % to about 20 wt. % |
| Metal Passivator | about 0.1 wt. % to about 5 wt. % |
| Diluent oil | about 0 wt. % to about 25 wt. % |
| Defoamant | about 0 wt. % to about 5 wt. % |

The weight % of the polysulfide mixture in the additive package is preferably from about 30 wt. % to about 50 wt. %, more preferably from about 43 wt. % to about 49 wt. %, based on the total additive package as are the following components. The weight % of the alkyl phosphate is preferably from about 3 wt. % to about 10 wt. %, more preferably from about 6 wt. % to about 9 wt. %. The weight % of the dispersant is preferably from about 5 wt. % to about 20 wt. %, more preferably from about 5 wt. % to about 12 wt. %. The weight % of the borated dispersant is preferably from about 0.5 wt. % to about 8 wt. %, more preferably from about 2 wt. % to about 5 wt. %. The weight % of the amine is preferably from about 8 wt. % to about 20 wt. %, more preferably from about 12 wt. % to about 16 wt. %. The weight % of the metal passivator is preferably from about 0.5 wt. % to about 5 wt. %, more preferably from about 0.5 wt. % to about 2 wt. %. The weight % of the defoamant is preferably from about 0.5 wt. % to about 3 wt. %, more preferably from about 0.5 wt. % to about 2 wt. %. The diluent oil is added to make the total percentages of all components of the additive package to total to 100%.

Additional Additives

In one embodiment, the lubricating compositions and functional fluids contain one or more auxiliary extreme pressure and/or anti-wear agents, corrosion inhibitors and/or oxidation inhibitors. Auxiliary extreme pressure agents and corrosion and oxidation inhibiting agents, which may be included in the lubricants and functional fluids of the invention, are exemplified by halogenated, e.g., chlorinated, aliphatic hydrocarbons such as chlorinated olefins or waxes; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters (e.g., the reaction product of dibutylamine, carbon disulfide, and methyl acrylate); dithiocarbamate-containing amides, prepared from dithiocarbamic acid and an acrylamide (e.g., the reaction product of dibutylamine, carbon disulfide, and acrylamide); alkylene-coupled dithiocarbamates (e.g., methylene or phenylene bis(dibutyldithiocarbamate); and sulfur-coupled dithiocarbamates [e.g., bis(S-alkyldithiocarbamoyl) disulfides]. Many of the above-mentioned auxiliary extreme pressure agents and corrosion-oxidation inhibitors also serve as anti-wear agents.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers.

Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kemer (Noyes Data Corporation, 1976), pages 125–162.

These additional additives, when used, are present in the inventive lubricating and functional fluid compositions at sufficient concentrations to provide the compositions with enhanced properties depending upon their intended use. For example, the detergents are added at sufficient concentrations to provide the inventive compositions with enhanced detergency characteristics, while the anti-foam agents are added at sufficient concentrations to provide the inventive compositions with enhanced anti-foaming characteristics. Generally, each of these additional additives is present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

In one embodiment, the lubricating compositions contain less than 2%, or less than 1.5%, or less than 1% by weight of a dispersant. In another embodiment, the lubricating compositions are free of lead based additives, metal (zinc) dithiophosphates, and alkali or alkaline earth metal borates.

In another embodiment, the combination of the dihydrocarbyl polysulfide and the phosphorus or boron compound, or mixtures thereof may be used in concentrates.

The concentrate may contain the above combination alone or with other components used in preparing fully formulated lubricants. The concentrate also contains at least one substantially inert organic diluent, which includes kerosene, mineral distillates, or one or more of the oils of lubricating viscosity discussed above. In one embodiment, the concentrates contain from 0.01% up to about 49.9%, or from about 0.1% up to about 45% by weight of the organic diluent.

The following Examples relates to lubricants of the present invention using the polysulfide compositions A and B from Table 1.

A complete gear lubricant additive package includes at least one organic polysulfide comprising less than about 88 wt. % trisulfide, at least one phosphorus or boron compound or mixtures thereof, a primary amine, a metal passivator, a diluent oil and a defoamant. Preferably, the polysulfide in the additive package comprises at least about 7.5 wt. % dihydrocarbyl tetrasulfide or higher sulfides. Preferably, the polysulfide in the additive package comprises less than about 5.5 wt. % dihydrocarbyl disulfide. More preferably, the polysulfide in the additive package comprises less than about 88 wt. % dihydrocarbyl trisulfide and at least about 7.5 wt. % dihydrocarbyl tetrasulfide or higher polysulfides.

EXAMPLE 1

Gear Oil Formulated with Low Trisulfide Component

The additive package shown in Table 3 may be blended by any conventional method with at least one base stock to achieve a gear lubricant of 80W-90 viscosity grade. The blend components are shown in Table 4.

TABLE 3

Additive Package Without Base stock

| Type of Additive | Weight % | Chemical Name |
|---|---|---|
| Extreme Pressure Agent | 46 | di-alkyl polysulfide |
| Extreme Pressure Agent/Anti-wear Agent | 9 | alkyl phosphates/phosphites |
| Rust Protection | 12 | alkyl amine |
| Dispersant | 8 | alkenyl succinimide |
| Dispersant | 4 | borated alkenyl succinimide |
| Corrosion Inhibitor | 1 | bis(dialkylthio)dimercapto-thiadiazole |
| Defoamant | 1 | polybutyl acrylate |
| Diluent Oil | balance to 100% | Mineral Oil |

TABLE 4

Finished 80W-90 Gear Lubricant Preparation

| Component | Weight % Additive |
|---|---|
| Package Based on Polysulfide Formulation A | 9.5% |
| Mineral Base Stocks | 89.5% |
| Pour Point Depressant | 1% |

The lubricant composition was evaluated in a standard gear lubricant test known as the FZG Shock Test S-A10/16, 6R/90 [run by the FORSCHUNGSSTELLE FÜR ZAHNRÄDER UND GETRIEBEBAU (FZG)], which examines the scuffing load capacity of API GL4 and GL5 lubricants, passing results were obtained. The results are shown in Table 5. Although one embodiment of a finished 80W-90 gear oil lubricant is shown in Table 4, the formulation may vary. For example, in another embodiment according to the present invention, the package based on polysulfide formulation A may range from about 9 to about 10 wt. %, the mineral base stock may range from about 80 to about 90 wt. %, the pour point depressant may range from about 1 to about 2 wt. %, and an optional defoamant may range from about 0 to about 1 wt. %.

TABLE 5

FZG Test Results

| Load Stage | Result | Description |
|---|---|---|
| 10 | Pass | No damage |
| 11 | Pass | No damage |
| 12 | Pass | Very light scuffing |

EXAMPLE 2

Comparative Example Using Gear Lubricant Formulated with High Trisulfide Component A gear lubricant was prepared using an additive package analogous to that shown in Table 3. The only difference in the two packages was the substitution of an equivalent weight of pure alkyl-trisulfide (TBPS 344 from ChevronPhillips) extreme pressure agent for the polysulfide component of the present invention. The resultant additive package was then blended by conventional means with appropriate base stocks to achieve a gear lubricant of 80W-90 viscosity grade. The blend components are shown in Table 6.

TABLE 6

Finished 80W-90 Gear Lubricant Preparation

| Component | Weight % Additive |
|---|---|
| Package Based on Trisulfide | 9.4% |
| Mineral Base Stocks | 88.8% |
| Pour Point Depressant | 1.6% |
| Defoamant | 0.2% |

When evaluated in a standard gear lubricant test known as the FZG Shock Test S-A10/16, 6R/90 [run by the FORSCHUNGSSTELLE FÜR ZAHNRÄDER UND GETRIEBEBAU (FZG)], which examines the scuffing load capacity of API GL4 and GL5 lubricants, failing results were obtained. The results are shown in Table 7.

TABLE 7

FZG Test Results -

| Load Stage | Result | Description |
|---|---|---|
| 10 | Fail | Light Scuffing |

A comparison of the results from the tests using low trisulfide polysulfide versus the high trisulfide polysulfide demonstrates superior FZG test results for the low trisulfide polysulfide containing additive package and fully formulated lubricating oil containing the low trisulfide polysulfide containing additive package.

Greases

Where the lubricant is to be used in the form of a grease, the lubricating oil generally is employed in an amount sufficient to balance the total grease composition and, generally, the grease compositions will contain various quantities of thickeners and other additive components to provide desirable properties. The dihydrocarbyl polysulfide is generally present in an amount from about 0.1% up to about 10%, or from about 0.5% up to about 5% by weight. The phosphorus or boron compound is generally present in an amount from about 0.1% up to about 8%, or from about 0.5% up to about 6% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, oleic acid, palmitic acid, myristic acid, cottonseed oil acids, and hydrogenated fish oil acids. Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-, intermediate- and high-molecular weight acids and of nut oil acids, aluminum stearate, and aluminum complex thickeners. Useful thickeners include hydrophilic clays that are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A lubricating composition comprising:

a major amount of an oil of a lubricating viscosity, at least one or an oil polysulfide comprising:

(i) less than 88% dihydrocarbyl trisulfide;

(ii) less than 5.5 wt. % dihydrocarbyl disulfide; and (iii) at least 7.5 wt. % dihydrocarbyl tetrasulfide or higher polysulfides; and a phosphorus compound or a boron compound, or mixtures thereof.

2. The lubricating composition of claim 1, wherein the organic polysulfide has hydrocarbyl groups that are each independently an alkyl group having from 1 to about 30 carbon atoms.

3. The lubricating composition according to claim 1, wherein the oil is a mineral oil or synthetic oil.

4. A concentrate comprising from 0.1% to 49.9% by weight of a substantially inert, organic diluent based on the total weight of the concentrate;

at least one hydrocarbyl polysulfide comprising less than about 88% dihydrocarbyl trisulfide;

less than 5.5 wt. % dihydrocarbyl disulfide;

at least 7.5 wt. % dihydrocarbyl tetrasulfide or higher polysulfides; and at least one phosphorus or boron compound or mixtures thereof.

5. A grease composition comprising at least one oil of a lubricating viscosity, at least one thickening agent;

at least one dihydrocarbyl polysulfide comprising less than 88% dihydrocarbyl trisulfide;

less than 5.5 wt. % dihydrocarbyl disulfide;

at least 7.5 wt. % dihydrocarbyl tetrasulfide or higher polysulfides; and at least one phosphorus or boron compound, or mixtures thereof.

6. A method of lubricating at least one contact surfaces to reduce friction, the method comprising the steps of:

introducing to at least one contact surface a lubricating composition comprising:

a major amount of an oil of lubricating viscosity;

at least one organic polysulfide comprising less than 88% dihydrocarbyl trisulfide;

less than 5.5 wt. % dihydrocarbyl disulfide;

at least 7.5 wt. % dihydrocarbyl tetrasulfide or higher polysulfides; and at least one phosphorus or boron compound, or mixtures thereof.

7. The method according to claim 6, wherein the lubricating composition further comprises an automatic transmission fluid, manual transmission fluid, transaxle lubricant, gear lubricant, open gear lubricant, enclosed gear lubricant, tractor lubricant, metal-working lubricant, hydraulic fluid or grease.

8. The method according to claim 6, wherein the contact surface comprises at least a portion of an automatic transmission, manual transmission, transaxle, gear open gear, enclosed gear, tractor, metal-working tool, hydraulic cylinder, wirerope, walking cam, rock drill, chain and conveyor belt, worm gear, bearing, rail or flange.

9. An additive package for a lubricant composition, the additive package comprising:

at least one organic polysulfide comprising:

(i) less than 88% dihydrocarbyl trisulfide;

(ii) less than 5.5 wt. % dihydrocarbyl disulfide; and at least 7.5 wt. % dihydrocarbyl tetrasulfide or higher polysulfides;

at least one phosphorus or boron compound, or mixtures thereof;

a primary amine;

a metal passivator;

a diluent oil; and a defoamant.

10. The lubricating composition in accordance with claim 1 further comprising a hydrocarbyl monosulfide, wherein the ratio of the monosulfide to the polysulfide from about 0.087 to about 0.112.

11. The concentrate in accordance with claim 4 further comprising a dihydrocarbyl monosulfide, wherein the ratio of the monosulfide to the polysulfide is from about 0.087 to about 0.112.

12. The grease composition in accordance with claim 5 further comprising a dihydrocarbyl monosulfide wherein, the ratio of the monosulfide to the polysulfide is from about 0.087 to about 0.112.

13. The method in accordance with claim 6 further comprising a dihydrocarbyl monosulfide wherein, the ratio of the monosulfide to the polysulfide is from about 0.087 to about 0.112.

14. The additive package in accordance with claim 9 further comprising a dihydrocarbyl monosulfide wherein, the ratio of the monosulfide to the polysulfide is from about 0.087 to about 0.112.

* * * * *